United States Patent [19]

Suwa et al.

[11] 4,025,336

[45] May 24, 1977

[54] ALUMINUM BRONZE HAVING A GOOD WEAR RESISTANCE

[75] Inventors: Masateru Suwa; Noboru Baba, both of Hitachi, Japan

[73] Assignee: Hitachi, Ltd., Japan

[22] Filed: May 5, 1976

[21] Appl. No.: 683,279

[30] Foreign Application Priority Data

May 16, 1975 Japan ..... 50-57315

[52] U.S. Cl. ..... 75/162

[51] Int. Cl.[2] ..... C22C 9/01

[58] Field of Search ..... 75/162, 160, 153, 157.5

[56] References Cited

UNITED STATES PATENTS

| | | | |
|---|---|---|---|
| 2,608,403 | 8/1952 | Luther | 75/162 X |
| 3,000,733 | 9/1961 | Hannon | 75/162 |
| 3,337,335 | 8/1967 | Fearnside | 75/157.5 |
| 3,773,504 | 11/1973 | Niimi et al. | 75/157.5 |

*Primary Examiner*—L. Dewayne Rutledge
*Assistant Examiner*—E. L. Weise
*Attorney, Agent, or Firm*—Craig & Antonelli

[57] ABSTRACT

The present aluminum bronze contains 4 to 12% by weight of aluminum, not more than 1% by weight of at least one of solid solution silicon and beryllium, and more than the eutectic composition in the equilibrium phase diagram for quasi-binary copper-aluminum (Cu-Al) and iron silicide alloy, but not more than 10% by weight of iron silicide, the balance being comprised substantially of copper, and has, as cast, a percent elongation of 10% or more, a tensile strength of 50 kg/mm$^2$ or more and a better wear resistance than the ordinary aluminum bronze.

13 Claims, 9 Drawing Figures

ALUMINUM BRONZE HAVING A GOOD WEAR RESISTANCE

The present invention relates to aluminum bronze, and more particularly to novel aluminum bronze having a good wear resistance.

To improve the wear resistance of copper alloy, attempts have been so far made to disperse a soft phase such as lead, a hard phase such as carbide, nitride, silicide, etc., or a solid lubricant such as graphite, molybdenum disulfide, etc. into a copper alloy, and it has been confirmed that the wear resistance can be considerably improved by dispersing manganese silicide into brass. The brass containing manganese silicide is disclosed in U.S. Pat. No. 3,337,335. It has been also confirmed that the manganese silicide is effective for improving the wear resistance of bronze or aluminum bronze, and several kinds of copper alloy containing manganese silicide have been commercially utilized. Furthermore, it has been also confirmed that the manganese silicide is dispersed mainly in the form of $Mn_5Si_3$.

However, an effect of the manganese silicide upon copper alloy has not been fully reported yet. The present inventors have made study of the effect of manganese silicide by themselves, and as a result it has been confirmed that, if the manganese silicide is crystallized in a hypoeutectic area in the equilibrium phase diagram for quasibinary system of copper alloy matrix and manganese silicide, the wear resistance is more lowered, to the contrary, than that of the alloy containing no manganese silicide. Furthermore, it has been found that the wear resistance is lowered with increasing content of manganese silicide in the hypoeutectic area. On the other hand, in the hypereutectic area considerable effects of manganese silicide have been observed. That is, it has been confirmed that the wear resistance is more improved with increasing content of manganese silicide. However, it has been also found that the percent elongation is considerably lowered to the contrary. For example, a brass alloy containing manganese silicide in the hypereutectic area in the brass, as cast, has a percent elongation of not more than 10%, and thus is very brittle. It has been also found that a copper alloy containing manganese silicide is liable to wear out a mate material when slided under a high surface pressure.

The reduction in percent elongation is inevitable when the rigid manganese silicide is contained, but is also due to the crystallization of manganese silicide as hexagonal column-like crystals. It can be presumed that the percent elongation would be increased if the manganese silicide could be crystallized not as the hexagonal column-like crystals, but as spherical or approximately spherical crystals. Furthermore, if the eutectic point in the equilibrium phase diagram for quasibinary copper alloy matrix and manganese silicide is shifted toward the less managanese silicide side, the amount of manganese silicide necessary for the wear resistance can be reduced, and consequently the reduction in the percent elongation can be suppressed.

However, the crystalliztion of manganese silicide as the spherical or approximately spherical crystals requires another new technology, which is almost impossible in the present circumstances.

Under these situations, the present inventors have tried to find compounds capable of producing a wear resistance as high as that of manganese silicide and crystallizing the compound as spherical crystals or approximately spherical crystals, for example, carbides, nitrides, silicides, etc., and also have tried to select such combinations of the compound and copper alloy matrix that the eutectic point of copper alloy containing said compound may be located at a side of as small amount of the compound as possible. Furthermore, the present inventors have tried to make levels of the wear resistance and percent elongation exceed the wear resistance and percent elongation of the brass alloy containing manganese silicide as a base. If the mechanical strength of copper alloy obtained is low, a friction surface layer is subject to flow translocation when the alloy is used as a sliding part, and thus an adhesive wear is liable to appear. Thus, the present inventors have set the mechanical strength of the copper alloy to be obtained, as cast, to 50 kg/mm² or more in terms of tensile strength.

An object of the present invention is to provide a novel copper alloy having a good wear resistance and a sufficiently satisfactory elongation.

Another object of the present invention is to provide a copper alloy having a wear resistance at least as high as that of a brass alloy containing manganese silicide, and an elongation higher than that of the brass alloy.

Other object of the present invention is to provide a copper alloy having a tensile strength of 50 kg/mm² or more, and a percent elongation of 10% or more, as cast.

Further object of the present invention is to provide a novel copper alloy capable of making a wear loss of a mate material smaller than the copper alloy containing manganese silicide.

The present invention provides an aluminum bronze containing 4 to 12% by weight of aluminum, not more than 1% by weight of at least one of solid solution silicon and beryllium, and more than an eutectic composition in the equilibrium phase diagram for quasibinary copper-aluminum alloy phase (Cu-Al)-iron silicide phase, but not more than 10% by weight of iron silicide, the balance consisting substantially of copper.

The present aluminum bronze has a higher wear resistance and higher elongation than those of a brass alloy containing manganese silicide, and has, as cast, a tensile strength of 50 kg/mm² or more, and a percent elongation of 10% or more. The wear loss of mate material is smaller than that of the brass alloy containing manganese silicide.

The iron silicide has been selected as a substitute for the manganese silicide, and has an effect upon the improvement of the wear resistance like the manganese silicide. Furthermore, the iron silicide is crystallized as spherical crystals or fine dendrite crystals by the copresence of beryllium and silicon, and thus it has been found that an increased amount of the iron silicide does not lower the elongation so remarkably. Furthermore, it has been found that, when the copper alloy matrix is aluminum bronze, the eutectic point in the equilibrium phase diagram for quasibinary copper alloy matrix phase and iron silicide phase is located at a side of the smallest amount of iron silicide. It has been also found that in that case the wear resistance is improved by the crystallization of iron silicide in the hypereutectic area. Therefore, aluminum bronze can have the best wear resistance and elongation by allowing the aluminum bronze to contain the iron silicide.

The iron silicide crystallized in aluminum bronze mainly possesses a form of $Fe_3Si$. Composition of the iron silicide in the aluminum bronze actually prepared has 80 to 84% by weight of iron, the balance being silicon.

In the present invention, 4 to 12% by weight of aluminum is appropriate. When an aluminum content is less than 4% by weight, a tensile strength of 50 kg/mm² or more cannot be obtained, whereas when the aluminum content is over 12% by weight, the aluminum bronze cannot be practically applied due to deposition of $\gamma$ phase and consequent increased brittleness. Thus, the most preferable effect of aluminum upon the mechanical strength appears at the aluminum content of 8.5 to 9.5% by weight.

An eutectic point in the equilibrium phase diagram of quasi-binary Cu-8.5–9.5 wt. % aluminum alloy phase and iron silicide phase is located at the side of very low iron silicide content, that is, 1 to 2% by weight of iron silicide. When the aluminum content is higher than said range, the eutectic point is shifted to a side of lower iron silicide content, whereas when the aluminum content is lower than said range, the eutectic point is shifted toward a side of higher iron silicide content. However, the shifting in the eutectic point by change in the aluminum content is a little.

The effect of iron silicide upon the wear resistance appears remarkably when the iron silicide content is above that at the eutectic point, in the most cases, above 2% by weight, but the iron silicide content must not exceed 10% by weight. When the iron silicide content exceeds 10% by weight, the percent elongation, as cast, sometimes becomes lower than 10%, if the aluminum content is high. To appropriately balance both tensile strength and elongation with each other, 3 to 5% by weight, especially about 4.2% by weight, of iron silicide is desirable. When aluminum bronze consisting of iron silicide, aluminum and copper being the balance is subjected to wear tests, wears are sometimes abnormally increased, resulting in an increase in wear loss of the mate material.

Observation of wear powders and wear surface by a scanning type electron microscope has revealed that the abnormal wear is due to such a fact that the iron silicide just under the friction surface is liable to be released from the matrix, the released iron silicide is disintegrated, and the disintegrated particles grind the mate material and aluminum bronze. When the iron silicide is crystallized as hexagonal column-like crystals or rod-like crystals as in the case of the manganese silicide, the iron silicide would not be released from the matrix, but the elongation would be inevitably lowered to a considerable degree, which is not appropriate. The present inventors have made study of reinforcement of the matrix to make the iron silicide hardly releasable from the matrix. This has been accomplished by adding at least one of beryllium and silicon to the aluminum bronze. Furthermore, it has been found that the presence of at least one of beryllium and silicon makes the iron silicide take form of much finer spherical or dendrite crystals, and the decrease in the elongation can be suppressed.

Beryllium and silicon undergo solid solution in matrix and increases the mechanical strength of the matrix, and consequently the iron silicide is made hardly releasable from the matrix. Beryllium content and silicon content must be each not more than 1% by weight, and a total of the beryllium content and the silicon content must be also not more than 1% by weight, when both beryllium and silicon are contained. When the content of at least one of beryllium and silicon exceeds 1% by weight, the percent elongation of the aluminum bronze, as cast, will be sometimes less than 10%, if the aluminum content or iron silicide content is high. In the case of the present aluminum bronze, its tensile strength reaches a peak when the content of at least one of beryllium and silicon is about 1% by weight, and the tensile strength is lowered, when the content exceeds about 1%. The elongation reaches a peak when the content of at least one of beryllium and silicon is 0.2 to 0.4% by weight, and the elongation is lowered when the content exceeds that value. To harmonize the tensile strength with the elongation, the content of at least one of beryllium and silicon is preferably in a range of 0.1 to 0.6% by weight, particularly preferably in a range of 0.4 to 0.5% by weight. When a larger elongation is especially required in the application, it is desirable to adjust the content of at least one of beryllium and silicon to 0.2 to 0.4% by weight. When a higher tensile strength is especially required in the application, it is desirable to adjust the content of at least one of beryllium and silicon to 0.8 to 1% by weight.

The present aluminum bronze can contain iron, nickel, and manganese, which are added to the ordinary aluminum bronze to improve the strength. These contents must be not more than 6% by weight for iron, not more than 7% by weight for nickel, and not more than 1.5% by weight for manganese, as contained in the ordinary aluminum bronze. The aluminum bronze sometimes contains zinc as an impurity, but the zinc content must be not more than 2% by weight in total of the manganese content.

The present aluminum bronze can be used as cast, or as forged from an ingot, or can be used after a heat treatment. It has been observed that a beryllium-containing alloy is liable to produce casting defects such as blow holes, etc. when ingots are made by sand casting, and a caution must be given at the melt casting. On the other hand, a silicon-containing alloy can readily produce good ingots.

The present aluminum bronze is used as sliding parts in rolling mills, machine tools, ship machinery, automobile machinery, etc, and can be applied, for example, to gears, bearings, worm wheels, rolling female screws or slipper metal of rolling mills, etc.

Now, the present invention will be described in detail referring to the accompanying drawings and Examples.

EXAMPLE 1

20 kinds of aluminum bronze were melted under the atmosphere in a high frequency induction furnace and then cast in molds to prepare test pieces. The tensile strength and percent elongation of the test pieces as cast were measured. Chemical composition, tensile strength and percent elongation of aluminum bronze test pieces thus obtained are shown in Table 1.

Table 1

| | Chemical composition (wt. %) | | | | | | |
|---|---|---|---|---|---|---|---|
| | Al | Iron silicide | Be | Ni | Fe | Tensile strength (kg/mm²) | Percent elongation (%) |
| 1 | 7 | — | — | — | — | 34 | 67 |
| 2 | " | 5 | — | — | — | 48 | 55 |
| 3 | " | " | 0.2 | — | — | 57 | 48 |
| 4 | " | " | 0.5 | — | — | 62 | 38 |
| 5 | " | " | " | 1 | — | 65 | 31 |
| 6 | 9 | " | — | — | — | 49 | 12 |
| 7 | " | " | — | 5 | 3 | 63 | 17 |
| 8 | " | " | 0.1 | — | — | 55 | 28 |
| 9 | " | " | 0.2 | — | — | 58 | 36 |
| 10 | " | " | 0.4 | — | — | 66 | 36 |
| 11 | " | " | 0.5 | — | — | 69 | 30 |
| 12 | " | " | 0.6 | — | — | 72 | 25 |
| 13 | " | " | 0.8 | — | — | 77 | 15 |
| 14 | " | " | 1.0 | — | — | 79 | 10 |
| 15 | " | " | 1.2 | — | — | 73 | 6 |
| 16 | 9 | 5 | 0.5 | — | 1 | 67 | 32 |
| 17 | " | " | " | 1 | " | 68 | 30 |
| 18 | " | " | " | 2 | — | 70 | 21 |
| 19 | " | 7 | " | 1 | 1 | 72 | 14 |
| 20 | 10.5 | 5 | " | — | 1 | 83 | 17 |

Test pieces Nos. 1–5 are aluminum bronzes containing 7% by weight of aluminum, and effects of iron silicide, beryllium and iron can be evidently seen from the comparison of these test pieces. That is, the tensile strength is drastically increased by the presence of iron silicide, and the tensile strength is further increased by the simultaneous presence of beryllium. Iron has an effect upon increase in the tensile strength.

Figure 1:
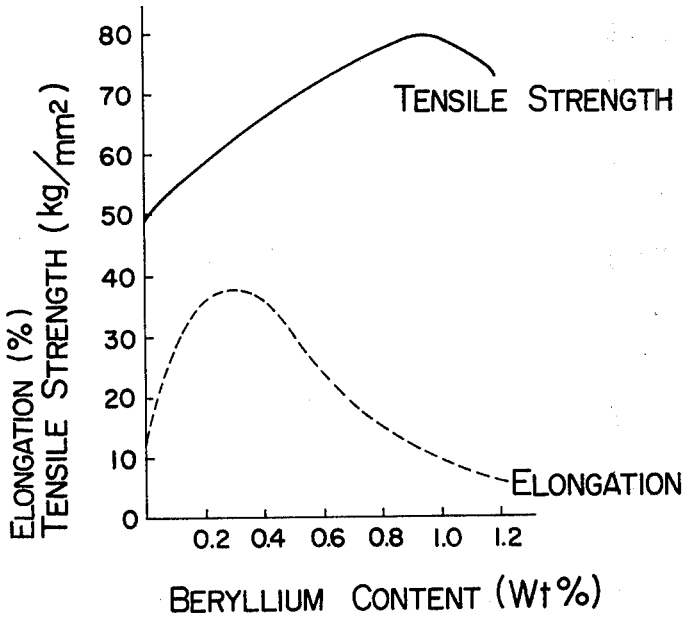
FIG. 1 is a characteristic diagram showing relations between the tensile strength or percent elongation and the beryllium content of the aluminum bronze containing iron silicide and beryllium.

Test pieces Nos. 6–18 are aluminum bronzes containing 9% by weight of aluminum and 5% by weight of iron silicide. Test pieces Nos. 6 and 7 contain no beryllium, but test pieces Nos. 8–18 contain beryllium. The tensile strength is considerably increased by the presence of beryllium, iron and nickel. As to test pieces Nos. 6 and 8–15, relations between the beryllium content and the tensile strength are shown in FIG. 1. It is evident from FIG. 1 that the peak of the tensile strength is at about 1% by weight of beryllium. It is also evident that the peak of the percent elongation is at 0.2 to 0.4% by weight of beryllium. To harmonize the tensile strength with the percent elongation, it is desirable that the beryllium content be 0.1 to 0.6% by weight, particularly 0.4 to 0.5% by weight, where a tensile strength over 55 kg/mm² and percent elongation over 25% can be obtained.

Figure 2:
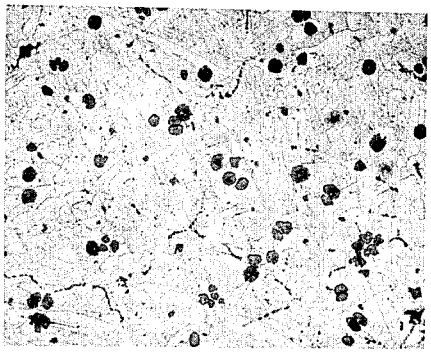
FIG. 2 is a picture of the microstructure of aluminum bronze No. 16 in Table 1.

FIG. 2 is a microscopic picture of the structure of aluminum bronze test piece No. 16, magnified to 400-fold, where it is evident that the iron silicide is crystallized in spherical forms.

Figure 3:
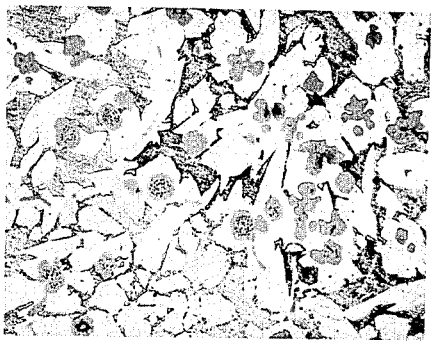
FIG. 3 is a picture of the microstructure of aluminum bronze No. 17 in Table 1.

FIG. 3 shows a microstructure of aluminum bronze test piece No. 17 under 400-fold magnification, where it is observed that the iron silicide is crystallized in forms of spherical crystals or fine dendrite crystals.

Figure 4:
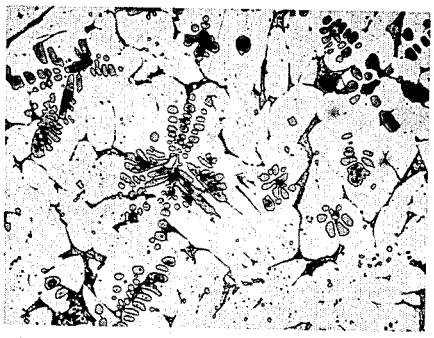
FIG. 4 is a picture of the microstructure of aluminum bronze No. 7 in Table 1.

FIG. 4 is a microscopic picture of the structure of aluminum bronze test piece No. 7 containing no beryllium under 400-fold magnification, where it is seen that the iron silicide is developed as rough dendrite crystals.

Figure 5:
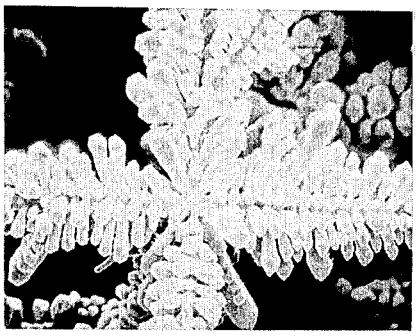
FIG. 5 is a picture showing a shape of iron silicide in aluminum bronze No. 7 in Table 1.
Figure 6:
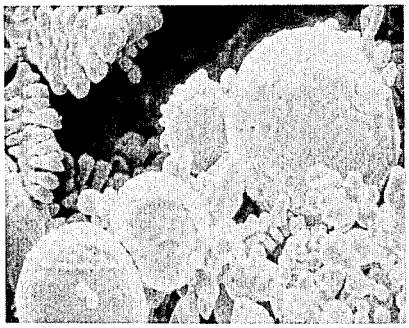
FIG. 6 is a picture of the microstructure of aluminum bronze No. 16 in Table 1.

FIGS. 5 and 6 are pictures of aluminum bronze test piece No. 7 containing no beryllium, and aluminum bronze test piece No. 17 containing beryllium, respectively, each of which was treated with nitric acid to dissolve the matrix and extract the iron silicide, and observed by a scanning type electron microscope. FIG. 5 is the picture of test piece No. 7, and FIG. 6 is that of test piece No. 17. Magnification is 600-fold in FIG. 5, and 1,000-fold in FIG. 6. It is seen from these pictures that the iron silicides have different shapes from each other. Analysis of chemical composition of these iron silicides by an X-ray microanalyzer reveals that the iron silicides have a composition very close to $Fe_3Si$, and contain a very small amount of nickel and aluminum.

EXAMPLE 2

Figure 7:
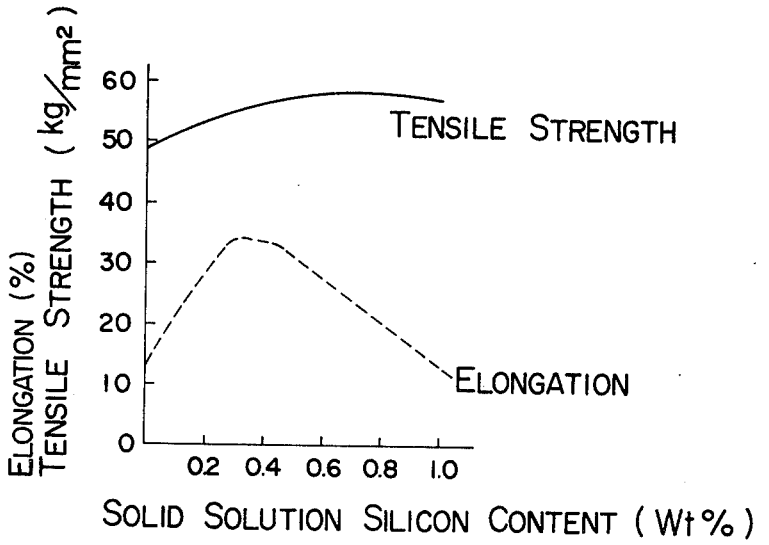
FIG. 7 is a characteristic diagram showing relations between the tensile strength or percent elongation and the solid solution silicon content of the aluminum bronze containing iron silicide and solid solution silicon.

Aluminum bronzes containing 8% by weight of aluminum, 4.2% by weight of iron silicide and 0 to 1% by weight of silicon in solid solution in matrix were melted in the atmosphere in a high frequency induction heater, and then sand casted to prepare test pieces. Then, tensile strength and percent elongation of the test pieces as cast were measured. Relations between the tensile strength or the percent elongation and content of silicon in cold solution in the matrix are shown in FIG. 7. It is seen that the peak of the tensile strength is at 0.8 to 1.0% by weight of silicon in solid solution in the matrix, and the peak of the percent elongation, is at 0.2 to 0.4% by weight of silicon in solid solution in the matrix.

EXAMPLE 3

Figure 8:
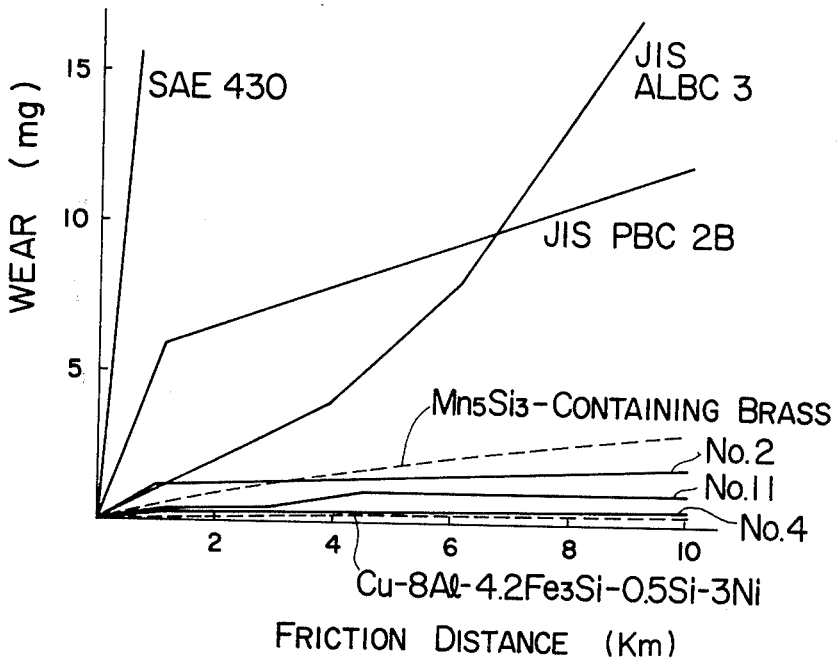
FIG. 8 is a characteristic diagram showing relations between the wear and the friction distance as a result of wear tests of various copper alloys.

To compare the wear resistance of the present aluminum bronze with those of the conventional wear-resistant copper alloys, reciprocating sliding wear tests were carried out at a surface pressure of 500 kg/cm² and average friction speed of 0.2 m/sec under oil lubrication, using a material JIS S45C (JIS: Japanese Industrial Standard; C 0.42 – 0.48 wt. %; Si 0.15 – 0.35 wt. %; Mn 0.60 – 0.90 wt. %; P < 0.030 wt. %; S < 0.035 wt. %; Fe balance) as a movable mate piece. The copper alloys used in the tests were test pieces Nos. 2, 4 and 11 of Table 1, an aluminum bronze containing 8% by weight of aluminum, 4.2% by weight of iron silicide, 0.5% by weight of solid solution silicon, and 3% by weight of nickel, a material SAE 430, JIS ALBC3 (Al 8.5 – 10.5 wt. %; Fe 3.0 – 6.0 wt. %; Ni 3.0 – 6.0 wt. %; Mn < 1.5 wt. %; Cu balance), a material JIS PBC2B (Sn 9.0 – 12.0 wt. %; P 0.15 – 0.50 wt. %; Cu balance), and $\beta$-brass containing 5.2% by weight of manganese silicide ($Mn_5Si_3$). Test results are shown in FIG. 8. There appeared adhesives in a wide area in test pieces other than the aluminum bronzes containing iron silicide and the $\beta$-brass containing manganese silicide, and abrasive wear due to the projections of developed adhesives took place, resulting in an increase in wear loss and also wear of the mate material. In the cases of the aluminum bronzes containing iron silicide and the brass containing manganese silicide, the wear of themselves and the wear of the mate material were less than in the cases of other test pieces. However, it is seen that the present aluminum bronzes are most distinguished in wear resistance.

Figure 9:
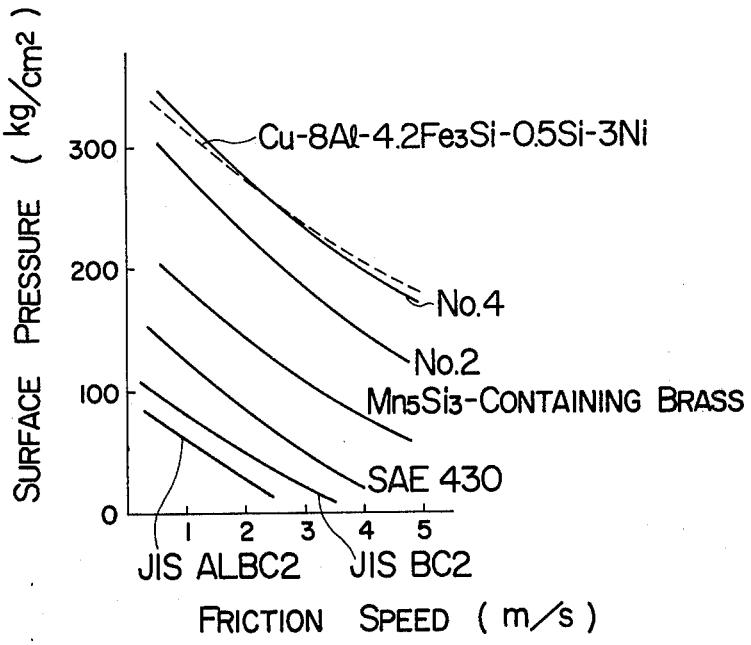
FIG. 9 is a characteristic diagram showing relations between the surface pressure and the friction speed.

Then, relations between critical surface pressure and friction speed, of various copper alloys, which produce a seizure, were investigated. The results are shown in FIG. 9, where the downside of each curve represents no occurrence of seizure, and the upside represents an occurrence of seizure. A curve at a higher surface pressure side means less occurrence of seizure. It is seen from FIG. 9 that the present aluminum bronzes are subject to much less seizure than other copper alloys.

As described above, the present aluminum bronze has a very distinguished wear resistance, and is better than the brass containing manganese silicide according to the data shown in Example 3.

The present aluminum bronze has a high tensile strength and a high percent elongation, and thus is very suitable as sliding parts of machinery.

What is claimed is:

1. An aluminum bronze having a good wear resistance, which comprises 4 to 12% by weight of aluminum, not more than 1% by weight of at least one of solid solution silicon and beryllium, and more than an eutectic composition in the equilibrium phase diagram for quasi-binary Cu-Al alloy phase and iron silicide phase but not more than 10% by weight of iron silicide, the balance being substantially copper.

2. An aluminum bronze having a good wear resistance according to claim 1, wherein 0.1 to 0.6% by weight of at least one of the solid solution silicon and beryllium is contained.

3. An aluminum bronze having a good wear resistance according to claim 1, wherein 2 to 10% by weight of the iron silicide is contained.

4. An aluminum bronze having a good wear resistance according to claim 1, wherein 3 to 5% by weight of the iron silicide is contained.

5. An aluminum bronze having a good wear resistance according to claim 1, wherein 8.5 to 9.5% by weight of aluminum is contained.

6. An aluminum bronze having a good wear resistance according to claim 1, wherein 0.4 to 0.5% by weight of at least one of the solid solution silicon and beryllium is contained.

7. An aluminum bronze having a good wear resistance, which comprises 4 to 12% by weight of aluminum, not more than 1% by weight of a least one of solid solution silicon and beryllium, more than an eutectic composition in the equilibrium phase diagram for quasi-binary copper-aluminum alloy phase and iron silicide phase, but not more than 10% by weight of iron silicide, and at least one of not more than 6% by weight of iron, not more than 7% by weight of nickel and not more than 1.5% by weight of manganese, the balance being substantially copper.

8. An aluminum bronze having a good wear resistance according to claim 7, wherein 0.1 to 0.6% by weight of at least one of the solid solution silicon and beryllium is contained.

9. An aluminum bronze having a good wear resistance according to claim 7, wherein 2 to 10% by weight of the iron silicide is contained.

10. An aluminum bronze having a good wear resistance according to claim 7, wherein 8.5 to 9.5% by weight of aluminum is contained.

11. An aluminum bronze having a good wear resistance according to claim 7, wherein not more than 6% by weight of iron is contained.

12. An aluminum bronze having a good wear resistance according to claim 7, wherein not more than 7% by weight of nickel is contained.

13. An aluminum bronze having a good wear resistance according to claim 7, wherein not more than 6% by weight of iron and not more than 7% by weight of nickel are contained.

* * * * *